United States Patent [19]

Reghi

[11] Patent Number: 4,812,175

[45] Date of Patent: Mar. 14, 1989

[54] PASSIVATION PROCESS AND COPMPOSITION FOR ZINC-ALUMINUM ALLOYS

[75] Inventor: Gary A. Reghi, Sterling Heights, Mich.

[73] Assignee: Parker Chemical Company, Madison Heights, Mich.

[21] Appl. No.: 62,344

[22] Filed: Jun. 10, 1987

Related U.S. Application Data

[63] Continuation of Ser. No. 773,405, Sep. 6, 1985, abandoned.

[51] Int. Cl.[4] ..... C23C 22/33

[52] U.S. Cl. ..... 148/258

[58] Field of Search ..... 148/6.16

[56] References Cited

U.S. PATENT DOCUMENTS

| | | | |
|---|---|---|---|
| 2,327,002 | 8/1943 | Thomson | 148/6.16 |
| 2,497,905 | 2/1950 | Ostrander | 148/6.16 |
| 2,527,828 | 10/1950 | Kruszynski | 148/6.16 |
| 2,634,224 | 4/1953 | Faucher | 148/6.16 |
| 3,074,827 | 1/1963 | Hoover | 148/6.16 |
| 3,219,489 | 11/1965 | Bellinger | 148/6.16 |
| 4,131,489 | 12/1978 | Newhard | 148/6.16 |

FOREIGN PATENT DOCUMENTS

| | | | |
|---|---|---|---|
| 632102 | 5/1945 | United Kingdom | 148/6.16 |
| 632100 | 6/1945 | United Kingdom | 148/6.16 |

*Primary Examiner*—Sam Silverberg

*Attorney, Agent, or Firm*—Ernest G. Szoke; Wayne C. Jaeschke; Mark A. Greenfield

[57] ABSTRACT

An aqueous acidic treating solution and process for forming a chromium-containing passivate coating on the surface of zinc or zinc-aluminum alloys to enhance bare corrosion resistance and inhibit discoloration thereof upon exposure to ambient environments. The treating solution contains as its essential constituents, chromium ions, nitrate ions, phosphate ions.

16 Claims, No Drawings

PASSIVATION PROCESS AND COPMPOSITION FOR ZINC-ALUMINUM ALLOYS

This is a continuation of co-pending application Ser. No. 773,405 filed on Sept. 6, 1985, abandoned.

BACKGROUND OF THE INVENTION

The present invention broadly relates to a process and aqueous composition for the treatment of metal surfaces, and more particularly, to a process and aqueous acidic treating solution for the treatment of zinc or zinc-aluminum alloys to form a passivate coating thereon thereby enhancing the corrosion resistance thereof.

It is known in the art to treat zinc surfaces such as galvanized hot dipped and electrolytic zinc-coated ferrous metals such as steel with aqueous acidic passivate solutions containing chromium for depositing a chromium-containing passivate coating thereon thereby substantially improving the resistance of the galvanized material to corrosion, discoloration and white rust formation. The term "zinc surfaces" is intended to encompass relatively pure zinc as well as zinc containing minor quantities of alloying elements. An aqueous treating solution, which is known and commercially employed for this purpose, employs chromate ions, boric acid and hydrofluoric acid as the principal ingredients. While such prior art treating solutions have been found satisfactory for treating substantially pure zinc metal surfaces, such treating solutions have now been found as unsatisfactory for the treatment and passivation of zinc-aluminum alloys which are in widespread commercial use as a substitute for conventional zinc-galvanized steel sheet. One such zinc-aluminum alloy is marketed under the brand name Galvalume and nominally contains about 55% by weight aluminum, 43.5% by weight zinc and about 1.5% by weight silicon. It has been observed that conventional passivation treatments of the types heretofore employed on substantially pure zinc-galvanized stock do not effectively prevent rapid darkening and/or discoloration of such zinc-aluminum alloy surfaces in an unpainted condition when exposed to normal atmospheric conditions. Such discoloration and/or darkening of the surface is objectionable.

The present invention provides for a novel composition and process by which such zinc or zinc-aluminum alloy surfaces can be effectively passivated substantially improving their corrosion resistance and inhibiting the tendency of the passivated surfaces to darken and/or discolor during exposure to ambient conditions.

SUMMARY OF THE INVENTION

The benefits and advantages of the present invention are achieved in accordance with the composition aspects thereof by providing an aqueous acidic solution containing chromium ions of which the predominant proportion are in the hexavalent state, nitrate ions and phosphate ions which are present in an amount sufficient to form a chromium-containing passivate coating on the zinc or zinc-aluminum alloy surface. The aqueous acidic treating solution can optionally further contain fluoride ions, molybdate ions and tungstate ions present in an amount effective to accelerate the coating action of the solution.

In accordance with a preferred practice of the present invention, the treatment solution is prepared employing a liquid concentrate which can conveniently be diluted with water to form an operating solution of the desired concentration.

In accordance with the process aspects of the present invention, the treating solution is applied to a clean zinc or zinc-aluminum surface such as a steel sheet coated with zinc or a zinc-aluminum alloy in a manner to provide a substantially uniform liquid film thereon of the desired thickness. The liquid film is subsequently dried. The time of application, temperature of the solution, concentration of the active constituents and the thickness of the liquid film are controlled so as to provide a chromium-containing coating of the desired weight.

Additional benefits and advantages of the present invention will become apparent upon a reading of the description of the preferred embodiments taken in conjunction with the specific examples provided.

DESCRIPTION OF THE PREFERRED EMBODIMENTS

In accordance with the composition aspects of the present invention, the passivate treating solution contains as its essential ingredients, hexavalent chromium ions, nitrate ions and phosphate ions in further combination with hydrogen ions to provide a pH on the acid side. The passivate solution can optionally further contain controlled amounts of fluoride ions, molybdate ions, tungstate ions as well as mixtures thereof for accelerating the coating reaction on the zinc-aluminum alloy surface.

The chromium ions can be introduced in the form of any solution soluble chromium compound such as chromic acid, alkali metal and ammonium chromates and dichromates as well as mixtures thereof. Preferably, the chromium ions are introduced as chromium acid or chromium trioxide which further imparts acidity to the solution. The chromium ions in the passivate solution are predominantly in the hexavalent state. Although the chromium is added as hexavalent chromium, some trivalent chromium may be present in the treating solution due to a reduction of the hexavalent chromium to the trivalent state during the coating reaction. The chromium ion concentration in the treating solution can broadly range from about 2 up to about 20 grams per liter (g/l) with a concentration of about 11 g/l being typical.

The nitrate ions can also be introduced into the treating solution in the form of any solution soluble and compatible nitrate compound such as nitric acid, alkali metal and ammonium nitrates as well as mixtures thereof. Nitric acid itself constitutes a preferred compound. The nitrate ions can be present in an amount of about 0.5 up to about 6 g/l in the operating solution with concentrations of about 3 g/l being typical.

The phosphate ions can also be introduced in the form of any solution soluble and compatible phosphate compound including alkali metal and ammonium phosphates and polyphosphate as well as phosphoric acid itself which constitutes a preferred compound. Generally, the concentration of the phosphate ions in the treating solution can range from about 1 up to about 15 g/l with concentrations of about 7 g/l being typical.

The treating solution is on the acid side with an operating pH of less than about 2 being typical. The appropriate acidity can be achieved by employing acidic components of the essential ingredients or in the case of the addition of salts, appropriate pH adjustment can be made utilizing a suitable acid.

It has been found by experimentation that an aqueous acidic treating solution of the foregoing composition is satisfactory for treating zinc or zinc-aluminum alloys. Accordingly, the treating solution can be employed for passivating both conventional zinc-galvanized steel strip as well as steel strip coated with a zinc-aluminum alloy, for example, thereby requiring only one treatment solution for both types of coated strip.

In the treatment of zinc-aluminum alloy surfaces, such as Galvalume, it has been found advantageous to further include in the operating solution activating ions which accelerate the coating reaction and also contribute to improved passivate coatings on the treated surface. Such optional additives include fluoride ions typically present in an amount of about 0.5 g/l which can be conveniently added as hydrofluoric acid; molybdate ions typically present in an amount of about 0.5 to about 0.7 g/l which can be introduced as the alkali metal and ammonium salt or molybdic acid of which sodium molybdate itself constitutes the preferred material for economic considerations; tungstate ions which can be conveniently introduced as an alkali metal tungstate salt of which sodium tungstate constitutes a preferred material and can be introduced with a concentration typically about 0.2 g/l.

The operating treating solution is conventionally prepared by first forming a concentrated solution of the essential ingredients which can subsequently be diluted with water to form an operating solution of the desired concentration. A suitable concentrate comprises 30.4% by weight of chromium trioxide (about 219 g/l chromium ions) about 4.35% by weight of 100% nitric acid (about 59 g/l nitrate ions), about 10.65% by weight of 100% phosphoric acid (about 142 g/l phosphate ions) and the balance water. A concentrate of the foregoing composition has a specific gravity of about 1.383.

In the preparation of the operating treating solution, the foregoing concentrate can be diluted with water such that the concentrate comprises from about 1% up to about 10% by volume of the treating solution.

In accordance with the process aspects of the present invention, the treating solution is applied to a clean zinc-aluminum alloy surface such as by spray, immersion, flooding, brushing, roller coating, or the like after which the excess treating solution is removed such as by squeegee. The squeegee control of the applied solution produces a relatively thin uniform liquid film which can be controlled in thickness so as to provide the desired coating weight of the resultant chromium-containing coating. The coating weight of the chromium-containing coating is also influenced by the length of time the solution is in contact with the surface, the temperature of the treating solution and the concentration of the active constituents therein.

Generally, the treating solution is controlled within a temperature ranging from about 100° up to about 190° F. with temperatures from about 130° up to about 160° F. being preferred. Typically, the treating solution is controlled at about 140° F.

The time of contact can range from as little as about 0.5 seconds up to about 1 minute or longer depending on the desired thickness of the chromium-containing passivate coating desired. After the excess liquid film has been removed such as by squeegee, the liquid film remaining is allowed to dry.

In normal commercial operation, a steel strip is typically first cleaned employing a solvent cleaner to remove any protective oil films thereon whereafter the strip is subjected to a suitable cleaning treatment such as by employing an alkaline cleaner. Thereafter, the strip is water rinsed and upon drying is submerged in a molten bath of a zinc-aluminum alloy to effect a hot dip galvanizing thereof. Upon solidification of the zinc-aluminum alloy coating, the strip can be directly contacted with the treating solution to effect passivation of the surfaces thereof.

In order to further illustrate the present invention, the following examples are provided. It will be understood that the examples are provided for illustrative purposes and are not intended to be limiting of the scope of the present invention as herein described and as set forth in the subjoined claims.

EXAMPLE 1

A hot dipped Galvalume coated steel test panel was treated in a treating solution in accordance with the present invention containing 0.71% by weight of chromium trioxide (about 3.7 g/l chromium ions), about 0.15% by weight of 68% nitric acid (about 1 g/l nitrate ions) and about 0.33% by weight of 75% phosphoric acid (about 2.4 g/l phosphate ions) and the balance water. Prior to treatment, the coated test panels were first wiped with mineral spirits to remove any protective oil film and contaminating substances and were thereafter subjected to a 10 second alkaline cleaning by spray application at a temperature of about 130° F. employing a proprietary alkaline cleaner sold under the brand name Parco® Cleaner 338 available from Parker Chemical Company. Thereafter the cleaned test panels were hot water rinsed for a period of five seconds at a temperature of about 120° F. Following the rinse treatment, the panels were immersed in the treating solution at a temperature of about 140° F. for a period of time to produce a chromium-containing passivate coating of approximately 1 milligram per square foot (mg/ft$^2$) of chromium when dried. The excess treating solution was squeegeed off and the residual liquid film was permitted to dry at room temperature.

The subsequent treated test panels were cut into test samples of a size of about 3.5 by 7.5 inches and were oiled with a vanishing oil sold under the brand name Castrol Rustillo DW-924 HF.

The test samples were thereafter subjected to a corrosion test established by suppliers of zinc or zinc-aluminum alloy coated steel to predict resistance to atmospheric weathering. The samples were first rinsed with mineral spirits to remove the protective oil film and were thereafter placed in glass trays of a size of 4.5×8.5×3 inches deep to which 0.75 liters of distilled water was added. The panels were placed submerged in the water and placed in a humidity cabinet maintained at a temperature of 100° F.

During the continuance of the test, the surface of the treated test sample was periodically checked to evaluate the presence of any darkening and/or discoloration. The test panels were rated on a scale of 1 to 8 in which 8 represents no discernable darkening whereas 1 represents complete darkening.

EXAMPLE 2

A second series of hot dipped Galvalume test panels were processed in accordance with the same procedure as described in Example 1 and subjected to accelerated corrosion testing. In this example, a treating solution was prepared containing 0.65% by weight chromium trioxide (about 3.4 g/l chromium ions), 0.14% by weight of 68% nitric acid (about 0.93 g/l nitrate ions), about 0.33% by weight of 75% phosphoric acid (about 2.4 g/l phosphate ions), about 0.07% by weight of 70% hydrofluoric acid (about 0.5 g/l fluoride ions), about 0.09% by weight sodium molybdate dihydrate (about 0.6 g/l molybdate ions), about 0.03% by weight sodium tungstate dihydrate (about 0.22 g/l tungstate ions) and the balance water.

EXAMPLE 3

For comparative purposes, a third series of hot dipped Galvalume test panels were processed and tested in the same manner as previously described in Example 1. The treating solution simulates a typical passivate solution heretofore employed for passivating galvanized steel and which has been found unsatisfactory for the passivation of zinc-aluminum alloys. The passivating solution contained 0.38% chromium trioxide (about 2 g/l chromium ions), about 0.11% by weight boric acid and about 0.11% by weight of 70% hydrofluoric acid.

EXAMPLE 4

For comparative purposes, a hot dipped Galvalume test panel was subjected to a mineral spirit wiping and alkaline cleaning followed by water rinsing in accordance with the same procedure as described in Example 1, but was not subjected to any passivation treatment. The cleaned-only test panel was subjected to accelerated corrosion testing in the same manner as the test samples of Examples 1–3.

The comparative test results and the chromium-containing coating weights obtained on the several test samples are set forth in Table 1.

TABLE 1

| EXAMPLE | Chromium Coating Weight ($mg/ft^2$) | BARE CORROSION Test Results 1100 hrs. | 2164 hrs. |
|---|---|---|---|
| #1 | 1.37 | 7.5 | 7.3 |
| #2 | 0.99 | 8 | 7.8 |
| #3 (comparative) | 1.03 | 3.9 | 2.5 |
| Cleaned-Only | — | 1 (after 168 hrs.) | — |

The cleaned-only test sample had completely darkened and failed the test after only 168 hours of exposure. After 1,100 hours of exposure, the test sample treated with the passivate solution of Example 1 exhibited only minimal darkening providing a rating of 7.5 while the test sample treated with the passivate solution of Example 2 retained a rating of 8 indicating no visible discoloration. In contrast, the test sample treated with a conventional passivate solution according to prior art practice as desribed in Example 3 sustained severe discoloration after 1,100 hours having a rating of only 3.9. The benefits of the treating solution as exemplified in Example 1 and 2 is further magnified by the results obtained at the conclusion 2,164 hours of test evidencing clear superiority over that of Example 3.

While it will be apparent that the preferred embodiments of the invention disclosed are well calculated to fulfill the objects above stated, it will be appreciated that the invention is susceptible to modification, variation and change without departing from the proper scope or fair meaning of the subjoining claims.

What is claimed is:

1. An aqueous, acidic, passivating solution for zinc and zinc-aluminum alloys, consisting essentially of:

(1) predominantly hexavalent, chromium ions present in about 2–20 p.grams/liter;

(2) phosphate ions present in about 1–15 p.grams/-liter;

(3) nitrate ions present in about 0.5–6 p.grams/liter;

(4) optionally, fluroide ions, molybdate ions, tungstate ions, or a mixture thereof, present in an amount effective to accelerate the formation of said coating;

(5) hydrogen ions, present in an amount effective to afford an acid pH; and (6) water.

2. The solution as defined in claim 1 further including sufficient hydrogen ions to provide a pH of less than about 2.

3. The solution as defined in claim 1 further including said fluoride ions.

4. The solution as defined in claim 3 in which said fluoride ions are present in an amount of about 0.5 g/l.

5. The solution as defined in claim 1 further including said molybdate ions.

6. The solution as defined in claim 5 in which said molybdate ions are present in an amount of about 0.5 to about 0.7 g/l.

7. The solution as defined in claim 1 further including said tungstate ions.

8. The solution as defined in claim 7 in which said tungstate ions are present in an amount of about 0.2 g/l.

9. An aqueous acidic concentrate containing the ingredients in claim 1 in a proportion so that after dilution with water the solution in claim 1 is formed.

10. The solution of claim 9 wherein said concentrate has a specific gravity of about 1.383.

11. The concentrate as defined in claim 9 consisting essentially of about 219 g/l chromium ions, about 59 g/l nitrate ions and about 142 g/l phosphate ions and water q.s. to 1 liter.

12. A process for formation of a chromium-containing passivate coating on a zinc or zinc-aluminum alloy surface, comprising:

(A) enhancing the corrosion resistance and inhibiting any tendency of the passivate coating surface to darken; by (B) contacting a clean zinc or zinc-aluminum alloy surface with a substantially uniform liquid film of an aqueous acidic passivating solution consisting essentially of (1) predominantly hexavalent, chromium ions present in about 2–20 p.b.w., (2) phosphate ions present in about 1–15 p.b.w., (3) nitrate ions present in about 0.5–6 p.b.w., (4) optionally, fluoride ions, molybdate ions, tungstate ions, or a mixture thereof, present in an amount effective to accelerate the formation of a said coating;

(C) maintaining the presence of hydrogen ions in said passivating solution sufficient to afford a pH of less than about 2.0;

(D) maintaining said contact for at least 0.5 seconds; and (E) allowing said film to dry.

13. The process as defined in claim 12 in which said solution further said contains ions selected from the group consisting of fluoride, molybdate, tungstate and mixtures thereof.

14. The process as defined in claim 12 including the further step of controlling the temperature of said solution within a range of about 100° to about 190° F.

15. The process as defined in claim 12 including the step of controlling the temperature of said solution within a range of about 130° to about 160° F.

16. The process as defined in claim 12 including the further step of controlling the coating step to form a chromium-containing coating having a weight of about 1 mg/ft$^2$ of chromium when dried.

* * * * *

UNITED STATES PATENT AND TRADEMARK OFFICE

CERTIFICATE OF CORRECTION

PATENT NO. : 4,812,175

DATED : March 14, 1989

INVENTOR(S) : Gary A. Reghi

It is certified that error appears in the above-identified patent and that said Letters Patent is hereby corrected as shown below:

On the title page, in item [54] and in column 1, in the title , "COPMPOSITION" should be --COMPOSITION--.

Signed and Sealed this

Twenty-first Day of April, 1992

*Attest:*

HARRY F. MANBECK, JR.

*Attesting Officer*

*Commissioner of Patents and Trademarks*